343-700 MS AU 256 EX
7/18/78 XR 4,101,895

United States Patent [19]

Jones, Jr.

[11] 4,101,895

[45] Jul. 18, 1978

[54] MULTIFREQUENCY ANTENNA SYSTEM INTEGRATED INTO A RADOME

[75] Inventor: Howard S. Jones, Jr., Washington, D.C.

[73] Assignee: The United States of America as represented by the Secretary of the Army, Washington, D.C.

[21] Appl. No.: 768,126

[22] Filed: Feb. 14, 1977

[51] Int. Cl.[2] ..... H01Q 1/28

[52] U.S. Cl. ..... 343/708; 343/700 MS; 343/846

[58] Field of Search ..... 343/700 MS, 708, 846, 343/854, 705

[56] References Cited

U.S. PATENT DOCUMENTS

| | | | |
|---|---|---|---|
| 2,990,546 | 6/1961 | Haas | 343/705 |
| 3,914,767 | 10/1975 | Jones | 343/708 |
| 4,010,470 | 3/1977 | Jones | 343/708 |
| 4,053,895 | 10/1977 | Malagisi | 343/700 MS |

*Primary Examiner*—Eli Lieberman
*Attorney, Agent, or Firm*—Nathan Edelberg; Robert P. Gibson; Saul Elbaum

[57] ABSTRACT

An antenna system that comprises two or more linear arrays within close proximity which can be integrated into a conical dielectric radome. The elements of each array are wedge shaped open-ended cavity radiators plated on the outside of the radome structure. The bottom edge of each element is shorted to an inside conducting surface. Each array is designed to be operated in a different frequency band. A simple coaxial line feeds each of the radiators.

9 Claims, 4 Drawing Figures

MULTIFREQUENCY ANTENNA SYSTEM INTEGRATED INTO A RADOME

RIGHTS OF THE GOVERNMENT

The invention described herein may be manufactured, used, and licensed by or for the United States Government for governmental purposes without the payment to us of any royalty thereon.

BACKGROUND OF THE INVENTION

The present invention is related to multifrequency, flush mounted antennas and, more particulary, is directed towards dual frequency antennas which are designed into the structure of a conical dielectric radome.

Necessarily, antennas are designed to perform a required electrical function, for example, transmitting or receiving signals of a desired bandwidth, direction, polarization, gain, or other relevant characteristics. However, often mechanical restrictions such as size, weight, location, and profile are just as important or more important considerations, especially when the electrical parameters would conventionally require wave guides that are bulky and heavy. This is the case for many missile systems, aircraft, reentry vehicles, and various projectiles. Low profile, ring, and wraparound conformal antennas are several solutions that provide some relief to these often vexatious considerations.

When a radome or similar structure is used to house the essential guidance or fuzing system the above solutions often do not provide a satisfactory answer, especially when dual frequency capabilities are required. Robert Pierrot in U.S. Pat. No. 3,864,690 incorporates into such a radome a dual frequency antenna by utilizing a dielectric whose thickness is transparent to a first frequency and a network of wires integral with the dielectric designed to be transparent with a second frequency. The system also includes a network of discontinuous elements to compensate for grating lobes originating from the network of continuous wires.

Robert Munson in U.S. Pat. No. 3,811,128 is pertinent in illustrating a microstrip antenna which can be mounted on the vehicular skin of an airplane or missile. This antenna system does not suggest the dual frequency capability of the Pierrot patent, yet is simpler in design and cheaper to build than the Pierrot patent.

What this invention is directed towards is an antenna system which combines the qualities of these two inventions into one superior, easy to build antenna system.

OBJECTS AND SUMMARY OF THE INVENTION

It is therefore one object of the present invention to provide an antenna system that consumes practically no additional space on the vehicle in which it is placed.

Another object of the present invention is to provide a multifrequency antenna that can be designed and constructed into a radome and yet still preserve its structural integrity.

A further object of the present invention is to provide a multifrequency antenna system whose linear arrays can be placed in close proximity.

Still another object of the present invention is to provide a multifrequency antenna system that allows design flexibility such as broader functions, extended capability, and pattern determination.

A still further object of the present invention is to provide a multifrequency antenna system with good efficiency and whose cross polarized components and coupling between arrays are minimized.

The foregoing and other objects are attained in accordance with one aspect of the present invention by an antenna system that consists of linear arrays placed in close proximity which can be designed and constructed into the structure of a conical radome. The basic radiators are wedge shaped elements which are short circuited at the base and best can be described as parallel plate elements or open-ended radiating cavities. One array is designed for operation at one frequency band, and the other at a different frequency band. The different frequencies result from different sizes of wedges in each array.

BRIEF DESCRIPTION OF THE DRAWINGS

Various objects, features, and attendant advantages of the present inventon will be more fully appreciated as the same becomes better understood from the following detailed description of the present invention when considered in connection with the accompanying drawings, in which.

DETAILED DESCRIPTION OF THE PREFERRED EMBODIMENT

Figure 1A:
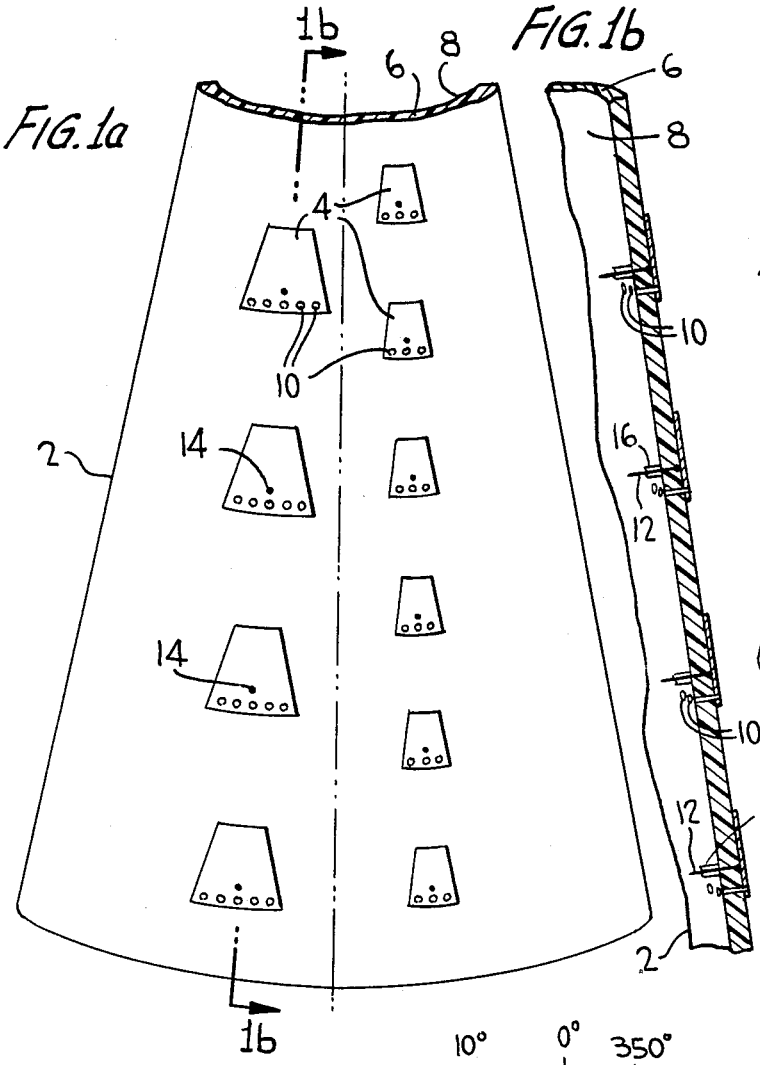
FIG. 1*a* is a plan view which schematically illustrates a preferred embodiment of the dual frequency antenna system integrated in a section of a radome.
Figure 1B:
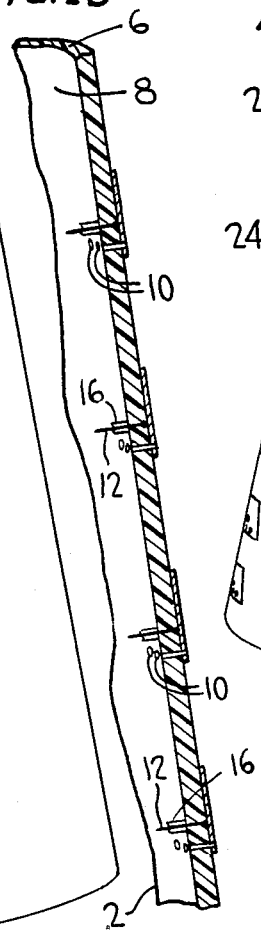
FIG. 1*b* is a cross-sectional view of FIG. 1*a* taken along line 1*b*—1*b* illustrating schematically one manner of coupling r.f. energy to the dual frequency antenna system.

Referring now to the drawings, wherein like reference numerals designate identical or corresponding parts throughout the several drawings illustrated, FIGS. 1*a* and 1*b* depict schematically a dual frequency antenna system of the present invention. The system consists of two linear arrays which are constructed into a radome referenced generally by numeral 2. The basic radiators 4 are wedge shaped parallel dielectric-loaded platelike elements. The wedge shaped patches 4 are conductively plated, preferably with copper, onto a radome of a dielectric substrate 6 which may, for example, be a silicon fiberglass material. The inside of the cone 8 is completely metal cladded, preferably with copper, and the patches 4 are parallel to this copper-plated inside surface. The bottom edge of each radiator 4 is connected electrically to the inside surface 8 by means of conductive shorting posts 10 generally in the form of plated-through holes. The number of posts is not critical so long as the bottom edge of the radiator is effectively shorted.

Each of the four radiators is fed from a coaxial line. As best illustrated in FIG. 1*b* the inner conductor 12 passes through the dielectric 6 and is soldered to the outside wedge shaped plate 4 at 14 as seen in FIG. 1*a*. The outside conductor 16 of the coaxial cable is electrically bonded to the inside surface 8. The position of the feed is a matter of the best impedance match.

Figure 2:
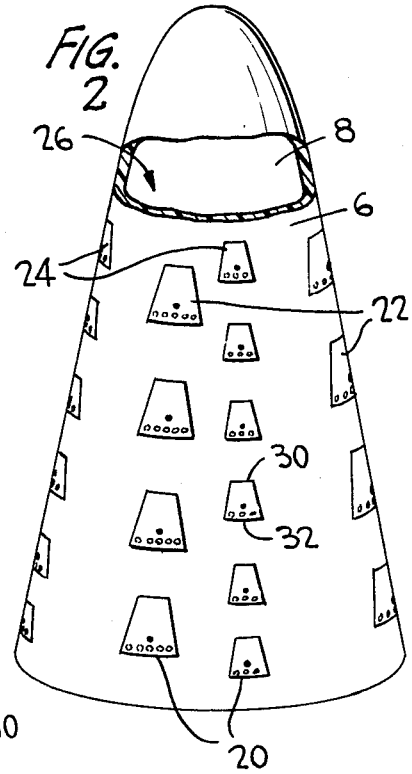
FIG. 2 is plan view which schematically illustrates an embodiment of the present invention where the dual frequency arrays appear in each quadrant of the radome.

FIG. 2 illustrates schematically a dual frequency antenna system incorporated into a complete radome. A dual array 20 is constructed in each quadrant separated by 90° on the circumference. This antenna design makes use of its radiating elements 22 and 24 in a manner such that they are compactly integrated into the radome structure of the missile. As in FIG. 1 the entire inner surface 8 of the structure is metal plated. Appropriate electronics can be easily housed within the structure (as indicated by 26), and the antenna system that normally occupies a large area within the radome can be eliminated. For antenna systems that operate in the L, S, and C bands the space savings can be enormous when considering the dual frequency operation.

The radome material 6 can be organic or inorganic (fused silica, ceramics, epoxy, silicon fiberglass, etc.) and the shape conical or cylindrical. These materials are usually low loss and the dielectric constant can range from $\epsilon = 2.0$ to 10. In one working embodiment a silicon fiberglass material is used, and the conically shaped radome has a 0.150-inch wall thickness uniformly throughout.

Figure 3:
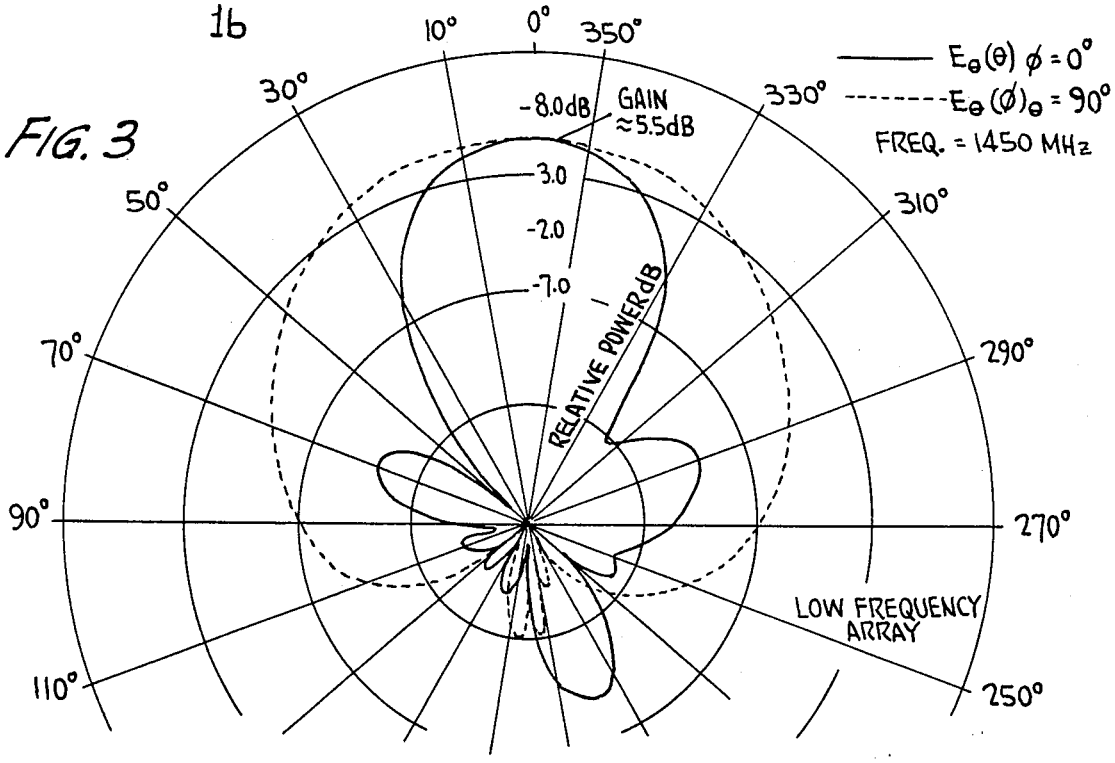
FIG. 3 illustrates graphically a typical broadside radiation pattern taken on the low frequency array in a silicon fiberglass radome section.

Each antenna array 22 and 24 is efficient and decoupling between the arrays is greater than 20db. This decoupling can be further enhanced and controlled by adjusting the elements in one array with respect to those in an adjacent array, e.g., by offsetting or staggering them as shown. The operating band of each array is determined by the size of the wedge shaped plates, the height of the radiators equaling approximately $\lambda/4$. Therefore in this example linear arrays 22 would operate at a lower frequency then linear arrays 24. A typical broadside pattern for a four element array operated at the selected operating frequency of 1450 MHz is illustrated in FIG. 3. The bottom edge of the wedge shaped radiator which connects with the inside surface was 1.125-inch long, the height of the radiator was $\lambda/4$, and across the top if measured 0.430-inch, the length of the upper 30 and lower 32 edge being a matter of desired characteristics and impedance matching. The pattern characteristic shown is highly desirable for a 4 element array. The efficiency of the radiators at the selected operating frequency is good, and the cross polarized components are minimized. Additionally, the elements can be phased to produce a selected beam angle, and since stripline feed networks are compatible with the antenna, occupying only a minimum of space, such phasing can be a relatively easy matter.

The antenna system described above solves the problem of conserving a considerable amount of space in a missile-fuze and guidance systems, plus it allows dual or multiple frequency operation for a variety of functions without sacrificing efficiency. Of course, numerous modifications and variations of the present invention are possible in light of the above teachings. The number of elements, configuration, size and shape of the wedges, the number of arrays, the number of frequencies utilized can be changed without departing from the spirit and scope of the invention.

What I claim is:

1. A multifrequency antenna system for integration into dielectric structures comprising:

A body whose structure is composed of a dielectric material;

Conductive plating on the inside surface of the body;

A plurality of conductive patches on the outside of the body forming one antenna array;

A second plurality of conductive patches on the outside of the body forming a second antenna array, wherein the first and second plurality of patches are wedge shaped and are each linearly aligned;

A means for shorting the bottom edge of the first and second plurality of conductive patches to the inside conductively plated surface; and Coupling means for energizing the arrays whereby an efficient multifrequency antenna is constructed with a minimum of cross polarized components and coupling between the arrays.

2. The multifrequency antenna system, as set forth in claim 1, wherein the shorting means comprise conductive posts.

3. The multifrequency antenna system, as set forth in claim 1, wherein the first and second plurality of patches appear in each quadrant of a radome.

4. The multifrequency antenna system, as set forth in claim 1, wherein the first and second plurality of patches are staggered and offset to enhance decoupling between the arrays.

5. The multifrequency antenna system, as set forth in claim 1, wherein the wedge shaped patches have a height of $\lambda/4$ where $\lambda$(wavelength) is determined by the selected operating frequency.

6. The multifrequency antenna system, as set forth in claim 5, wherein the coupling means is a coaxial cable with the inner conductor of the cable extending through the dielectric and bonded to the wedge shaped patches near the shorted edge.

7. The multifrequency antenna system, as set forth in claim 6, wherein the dielectric material has plated through holes acting as the shorting means.

8. The multifrequency antenna system, as set forth in claim 5, wherein the bottom, shorted edge of the antenna is longer than the upper edge of the antenna.

9. The multifrequency antenna, as set forth in claim 5, wherein the first and second plurality of wedge shaped patches are of different heights and therefore have different operating frequencies.

* * * * *